US005920757A

United States Patent [19]

Izawa et al.

[11] Patent Number: 5,920,757

[45] Date of Patent: Jul. 6, 1999

[54] HEATER HAVING AN OFFSET TEMPERATURE DETECTING ELEMENT AND IMAGE HEATING APPARATUS HAVING THE HEATER

[75] Inventors: Satoru Izawa, Shizuoka-ken; Masami Takeda, Yokohama; Toshio Miyamoto, Numazu; Yozo Hotta, Susono; Masahiko Suzumi, Numazu, all of Japan

[73] Assignee: Canon Kabushiki Kaisha, Tokyo, Japan

[21] Appl. No.: 09/016,288

[22] Filed: Jan. 30, 1998

[30] Foreign Application Priority Data

Feb. 3, 1997 [JP] Japan ..... 9-034419

[51] Int. Cl.[6] ..... G03G 15/20

[52] U.S. Cl. ..... 399/329; 219/216; 399/335

[58] Field of Search ..... 399/329, 320, 399/335, 69, 328; 219/216, 469–471; 118/60; 432/60

[56] References Cited

U.S. PATENT DOCUMENTS

| | | | |
|---|---|---|---|
| 5,162,634 | 11/1992 | Kusaka et al. . | |
| 5,306,898 | 4/1994 | Yukawa et al. . | |
| 5,338,919 | 8/1994 | Tagashira et al. . | |
| 5,376,773 | 12/1994 | Masuda et al. . | |
| 5,444,521 | 8/1995 | Tomoyuki et al. . | |
| 5,464,964 | 11/1995 | Okuda et al. . | |
| 5,621,510 | 4/1997 | Okuda et al. | 219/216 X |
| 5,732,318 | 3/1998 | Natsuhara et al. | 399/329 |

FOREIGN PATENT DOCUMENTS

| | | |
|---|---|---|
| 0 360 418 | 3/1990 | European Pat. Off. . |
| 0 372 479 | 6/1990 | European Pat. Off. . |
| 0 486 890 | 5/1992 | European Pat. Off. . |
| 0 546 495 | 6/1993 | European Pat. Off. . |
| 0 604 977 | 7/1994 | European Pat. Off. . |
| 2 718 822 | 11/1978 | Germany . |
| 3 248 203 | 6/1984 | Germany . |
| 63-313182 | 12/1988 | Japan . |
| 2-157878 | 6/1990 | Japan . |
| 3-226985 | 10/1991 | Japan . |
| 4-44075 | 2/1992 | Japan . |
| 4-204980 | 7/1992 | Japan . |
| 4-204981 | 7/1992 | Japan . |
| 5-273880 | 10/1993 | Japan . |
| 6-118817 | 4/1994 | Japan . |
| 6-274068 | 9/1994 | Japan . |
| 1 278 411 | 6/1972 | United Kingdom . |

OTHER PUBLICATIONS

U.S. application No. 08/925,618, Ohtsuka, filed Sep. 9, 1997.

*Primary Examiner*—S. Lee

*Attorney, Agent, or Firm*—Fitzpatrick, Cella, Harper & Scinto

[57] ABSTRACT

In an image heating apparatus, a film has one face in sliding contact with a heater having a heat generating portion on a substrate. The other face of the film contacts a recording material bearing an image. The film moves with the recording material and the image on the recording material is heated by heat generated by the heater which is transmitted through the film. A temperature detecting element detects the temperature of the heater. The heat generating portion of the heater has a first heat generating portion and a second heat generating portion on the downstream side of the first heat generating portion with respect to the moving direction of the film. The middle of the temperature detecting element is positioned at the upstream side of the middle between the first and second heat generating portions with respect to the moving direction of the film.

21 Claims, 8 Drawing Sheets

HEATER HAVING AN OFFSET TEMPERATURE DETECTING ELEMENT AND IMAGE HEATING APPARATUS HAVING THE HEATER

BACKGROUND OF THE INVENTION

1. Field of the Invention

The present invention relates to an image heating apparatus and a heater therefor, adapted for use in an image forming apparatus as represented by a copying machine, a printer or a facsimile apparatus, employing an image forming process such as an electrophotographic process or an electrostatic recording process, for the purpose of heating an image, formed by a transfer method or a direct method in an image forming process unit and supported by a recording material.

2. Related Background Art

As a heat fixing device in the image forming apparatus, there has conventionally been employed devices for a heat roller method or a film heating method. In particular, for the purpose of dispensing with the electric power supply to the heat fixing device in the stand-by state thereby minimizing the electric power consumption, there has been proposed a heat fixing device of a film heating method, in which a film is provided between the heater and the pressing roller for fixing the toner image on the recording material, as proposed for example in the Japanese Patent Laid-Open Application Nos. 63-313182, 2-157878, 4-44075 and 4-204980.

FIG. 8 schematically shows the principal parts of such a heat fixing device, which is provided with a heating member (hereinafter called heater) 41 fixed to and supported by a stay holder (support member) 42, and an elastic pressure roller 50 maintained in pressure contact, across a heat-resistant thin film (hereinafter called fixing film) 43, with the heater 41, forming therebetween a nip portion (fixing nip portion) N of a predetermined nip width.

The heater 41 is heated to and maintained at a predetermined temperature by the electric power supply. The fixing film 43 is composed of a cylindrical or endless belt-shaped member or a roll-fed web-shaped member which is conveyed in a direction indicated by an arrow a, by the rotating force of the pressure roller 50 or unrepresented drive means, in close contact with and sliding on the surface of the heater 41 at the fixing nip portion N.

In a state in which the heater 41 is heated to and maintained at the predetermined temperature and the fixing film 43 is conveyed in the direction a, if a recording material P bearing thereon an unfixed toner image t, which is to be heated, is inserted between the fixing film 43 at the fixing nip portion N and the pressure roller 50, the recording material P is closely contacted with a face of the fixing film 43 and introduced into the fixing nip portion N together with the fixing film 43. In the fixing nip portion N, the toner image t is heated by the heater 41 through the fixing film 43 whereby the toner image t is heat fixed to the recording material P. After passing the fixing nip portion N, the recording material is separated from the fixing film 43 and conveyed further.

The heater 41 constituting the heating member is generally composed of a ceramic heater, which is formed by providing a face (opposed to the fixing film 43) of an electrically insulating ceramic substrate 41*a* with a good thermal conductivity and a low heat capacity, composed for example of alumina, with an electrothermal heat-generating resistor layer 41*b* composed for example of silver-palladium (Ag/Pd), $Ta_2N$ etc. and extended in the longitudinal direction of the substrate (perpendicular to the plane of the drawing) for example by screen printing, and coating the surface bearing such heat-generating resistor layer with a thin protective glass layer 41*c*.

In this ceramic heater 41, the heat-generating resistor layer 41*b* generates heat upon receiving an electric power supply, whereby the temperature of the entire heater including the ceramic substrate 41*a* and the protective glass layer 41*c* is elevated rapidly. The temperature rise in the heater 41 is detected by a temperature detecting sensor 44 provided at the back of the heater and is fed back to an unrepresented power supply control unit, which controls the electric power supply to the heat-generating resistor layer 41*b* in such a manner that the heater temperature detected by the temperature detector 44 is maintained at a substantially constant temperature (fixing temperature). In this manner the heater 41 is heated to and maintained at the predetermined fixing temperature.

The fixing film 43 is made as thin as 20 to 70 $\mu$m in order that the heat of the heater 41 can be efficiently transferred to the recording material P at the fixing nip portion N. The fixing film 43 has a three-layered structure, consisting of a film base layer, a primer layer and a releasing layer, with the film base layer facing the heater 41 and the releasing layer facing the pressure roller 50. The film base layer is composed for example of polyimide, polyamidimide or PEEK which has higher insulating property than the protective glass layer 41*c* and which is also provided with a high heat resistance and a high elasticity. The film base layer maintains the mechanical strength, such as tear strength, of the entire fixing film 43. The primer layer is made as thin as 2 to 6 $\mu$m. The releasing layer functions to prevent the toner offsetting to the fixing film 43 and is composed of a coating of fluorinated resin such as PFA, PTFE or FEP with a thickness of about 10 $\mu$m.

The stay holder 42, composed for example of a heat-resistant plastic member, supports the heater 41 and functions also as a conveying guide member for the fixing film 43.

In the heat fixing device utilizing film heating method with such thin fixing film 43, because of the high rigidity of the ceramic heater 41, the pressure roller 50 having the elastic layer 51 becomes flat, following the shape of the flat lower face of the ceramic heater 41, thereby forming a nip portion N of a predetermined width at the contact position, and a quick-start heat fixing is achieved by heating such fixing nip portion N only.

FIG. 9 shows the details of the structure of the heater 41 employed in the heat fixing device of the above-explained film fixing method. The width W of the heat-generating resistor layer 41*b* of the heater 41 is contained within the fixing nip portion N, for fixing the toner image borne on the recording material through the fixing film 43. Consequently the heat generated by the heat-generating resistor layer 41*b* of the heater 41, by the electric power supply thereto, is given to the recording material P conveyed between the fixing film 43 and the pressure roller 50, thereby fusing and fixing the toner image t on the recording material P.

Behind the heater 41, as shown in FIG. 9, there are provided a temperature detector 44 such as a thermistor and a thermal protector 45 composed for example of a temperature fuse or a thermoswitch for shutting down the power supply to the heat-generating resistor layer 41*b* of the heater 41 in case of an abnormal operating condition, and these members are positioned within the conveying range of the recording material P of minimum width, that can be conveyed on the image forming apparatus.

The temperature detector 44 is positioned at the back of the heater 41, at the approximate center of the width W of the heat-generating resistor layer 41*b*, in order that the heat therefrom can be easily received. Also the thermo protector 45 is positioned at the back of the heater 41, at the approximate center of the width W of the heat-generating resistor layer 41*b*.

In the heat fixing device of the above-explained film heating method, however, the heat capacity of the pressure roller 50, the stay holder 42, the heater 41 etc. is made as small as possible, in order to ensure quick-starting performance. In such a situation, the position of the temperature detector 44 at the back of the heater 41, in addition to the performance thereof, has significant influence on the fixing of the toner image on the recording material and on the offsetting thereof, and has therefore to be determined precisely.

FIG. 10 is a chart showing the temperature distribution on the surface of the heater 41, from the upstream side of the fixing nip N to the downstream side thereof, while the fixing film is conveyed, wherein the abscissa indicates the position in the fixing nip N while the ordinate indicates the surface temperature of the heater. As will be understood from this chart, the surface temperature of the heater 41 is highest an area close to the center of the heat-generating resistor layer 41*b*, but becomes lower toward the upstream or downstream side in the fixing nip N. The temperature is higher in the downstream side than in the upstream side, because the upstream side receives the unheated fixing film while the sufficiently heated fixing film is discharged toward the downstream side.

In case the position of the temperature detector 44, provided in contact with the rear face of the heater 41, is displaced in the upstream or downstream direction, the temperature detected by the temperature detector 44 becomes different from the actual heating state of the heater in individual unit of the heat fixing device. For this reason, each heat fixing device has a higher possibility of causing defects such as insufficient fixing or toner offset by a high temperature. In order to avoid such drawbacks, the position of the temperature detector 44, on the rear face of the heater 41, has to be defined more precisely with a smaller tolerance of positioning, whereby the productivity of the heater 41 is inevitably lowered.

In addition, the thermo protector 45 such as a temperature fuse is provided for shutting down the power supply to the heat-generating resistor layer 41*b* in case of an abnormal heating state in such power supply, caused by a failure in the control unit for controlling the power supply to the heat-generating resistor layer 41*b* or in a safety circuit.

In case the thermo protector 45 is provided in contact with the rear face of the heater 41 corresponding to the central part of the heat-generating resistor layer 41*b*, it is therefore in an area of the highest temperature also in the normal state of use, so that the functioning temperature of such thermo protector has to be set higher than the highest temperature reached in the ordinary state of use. For this reason it has been difficult to improve the response speed of the thermo protector 45 for shutting down the power supply to the heat-generating resistor layer 41*b* in case of an abnormal heating state.

Also the thermistor constituting the temperature detector and the thermo protector are mounted with an adhesive material to the heater board, and such adhesive material has been associated with a drawback of being thermally deteriorated after prolonged exposure to heat, thus losing the adhesive power and thereby rendering the temperature detection unstable.

SUMMARY OF THE INVENTION

An object of the present invention is to provide an image heating apparatus and a heater therefor, capable of exact temperature control even in the presence of a certain aberration in the position of the temperature detecting element.

Another object of the present invention is to provide an image heating apparatus and a heater therefor, capable of achieving a faster response in shutting down the power supply to the heater in case of an abnormal temperature rise.

Still another object of the present invention is to provide an image heating apparatus and a heater therefor, capable of preventing thermal deterioration of the adhesive material for mounting the temperature detecting element.

Still another object of the present invention is to provide an image heating apparatus including a first heat generating portion and a second heating generating portion positioned at the downstream side of the first heat generating portion with respect to the moving direction of a film, wherein the center of the temperature detecting element is positioned at the upstream side with respect to the center between the first and second heat generating portions.

Still another object of the present invention is to provide an image heating apparatus including a first heat generating portion and a second heating generating portion which are arranged in a direction perpendicular to the longitudinal direction of a substrate member, wherein the center of the temperature detecting element is positioned at the side of the first heat generating portion with respect to the center between the first and second heat generating portions.

Still other objects of the present invention, and the features thereof, will be become fully apparent from the following description which is to be taken in conjunction with the attached drawings.

DETAILED DESCRIPTION OF THE PREFERRED EMBODIMENTS

In the following there will be given a detailed description of the image forming apparatus of the present invention and the heater for the heat fixing device.

Figure 1:
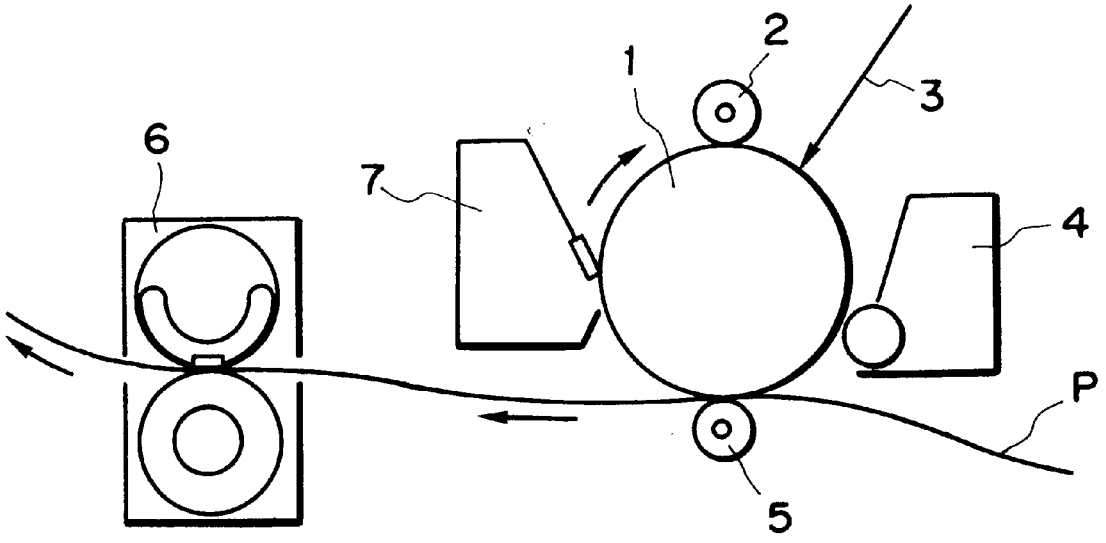
FIG. 1 is a view showing the construction of an image forming apparatus of the present invention.

Prior to the explanation of the embodiments, reference is at first made to FIG. 1 for explaining an image forming apparatus embodying the present invention.

Referring to FIG. 1, a photosensitive drum 1 is provided, on a cylindrical substrate composed for example of aluminum or nickel, with a photosensitive material composed for example of OPC, amorphous Se or amorphous Si and so on. The photosensitive drum 1 is rotated in a direction indicated by an arrow, and the surface thereof is at first uniformly charged with a charging roller 2 constituting a charging device. Then it is subjected to scanning exposure with a laser beam 3 which is on-off controlled according to the image information, whereby an electrostatic latent image is subsequently developed into a visible image by a developing device 4. The image development can be achieved for example by jumping development, two-component toner development or FEED development. It is often achieved by the combination of imagewise exposure and reversal development.

The visible toner image is transferred from the photosensitive drum 1, by a transfer roller 5 constituting a transfer device, onto a recording material P conveyed at a predetermined timing. In this operation, the recording material P is conveyed in pinched state between the photosensitive drum 1 and the transfer roller 5 with a predetermined pressure therebetween. The recording material P bearing the transferred toner image thereon is conveyed to a fixing device 6 and the toner image is fixed therein as a permanent image. The toner remaining on the photosensitive drum 1 after the image transfer is removed from the surface of the photosensitive drum 1 by a cleaning device 7.

Figure 2:
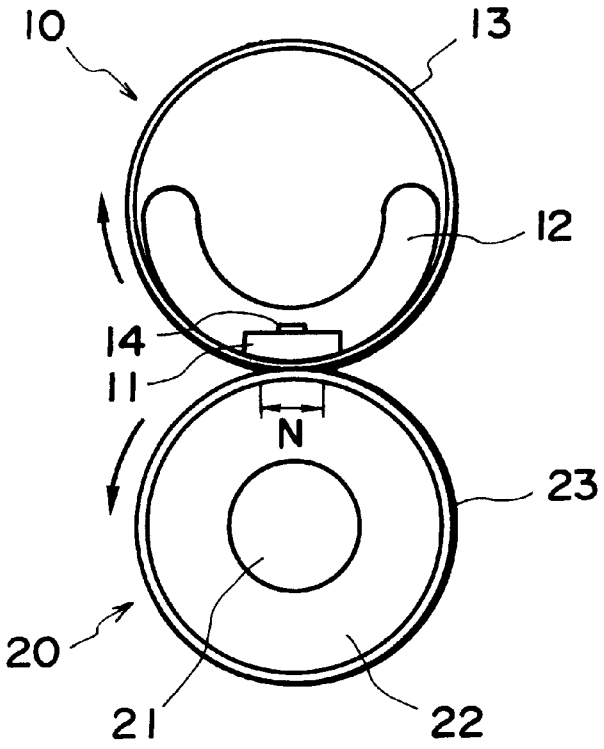
FIG. 2 is a construction view of a heat fixing device of the present invention.

FIG. 2 shows the configuration of the heat fixing device 6 of the present invention, which is composed of a fixing member 10 and a pressurizing member 20, wherein the fixing member 10 includes a heater 11, a temperature detecting element 14, a heat insulating stay holder 12 and a fixing film 13.

The fixing film 13 is composed of a heat-resistant film such as of polyimide, polyamidimide, PEEK, PES, PPS, PFA, PTFE or FEP and so on with a thickness not exceeding 100 $\mu$m in order to reduce the heat capacity thereby enabling quick start. On the other hand, a thickness of at least 20 $\mu$m is required for ensuring a sufficient mechanical strength and sufficient durability in order to obtain a long service life in the heat fixing device, while a thickness not exceeding 100 $\mu$m is preferred in consideration of the heat conduction. Also for preventing the toner offsetting and ensuring separation of the recording material, the fixing film is surfacially coated with heat-resistant resin of satisfactory releasing property, such as PFA, PTFE, FEP or silicone resin and so on either singly or as a mixture thereof.

The heater 11 is provided inside the fixing film 13, for the purpose of heating a nip portion N for fusing and fixing the toner image on the recording material. The structure of the heater 11 will be explained later in more details.

The heat insulating stay holder 12 is provided for supporting the heater 11 and for avoiding heat dissipation in a direction opposite to the nip, and is composed for example of liquid crystal polymer, phenolic resin, PPS or PEEK. The fixing film 13 is loosely fitted on the stay holder 12 and is rendered rotatable in a direction indicated by an arrow. The fixing film 13 is maintained free of tension in a part thereof, for example a part position downstream of the nip portion N, even during the driving operation of the fixing film.

As the fixing film 13 rotates in sliding contact with the heater 11 and the heat insulating stay holder 12 positioned inside the fixing film 13, the frictional resistance therebetween is preferably maintained low. For this purpose, a small amount of lubricant such as heat-resistant grease is made present on the surface of the heater 11 and the heat insulating stay holder 12, thereby realizing smooth rotation of the fixing film 13.

The pressurizing member 20, constituting a back-up member, is composed of a core metal 21 and an externally coated elastic layer 22, composed for example of heat-resistant rubber such as silicone rubber or fluorinated rubber, or foamed silicone rubber. A releasing layer 23 for example PFA, PTFE or FEP may further be provided thereon.

The pressurizing member 20 is sufficiently pressurized, at both ends in the longitudinal direction by unrepresented pressurizing means, toward the fixing member 10 so as to form a nip required for heat fixation, and the core metal 21 is rotated in a direction indicated by an arrow, at an end in the longitudinal direction by represented driving means. Thus the fixing film 13 rotates, as indicated by an arrow, along the outside of the stay holder 12. Otherwise the fixing film 13 may be rotated by rotating an unrepresented driving roller provided inside the fixing film 13.

Figure 3:
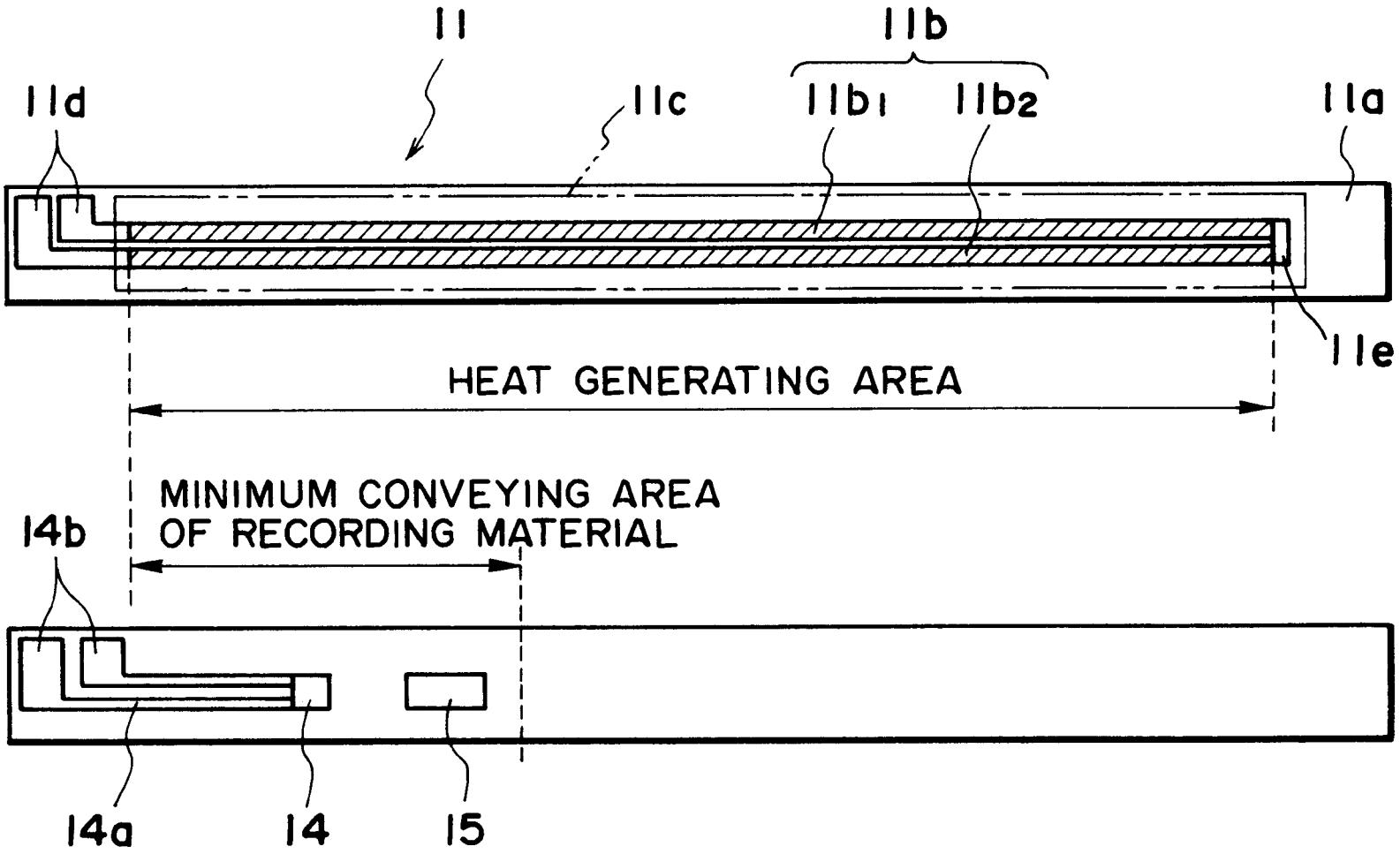
FIG. 3 is an explanation view showing the construction of a heater embodying the present invention.
Figure 4:
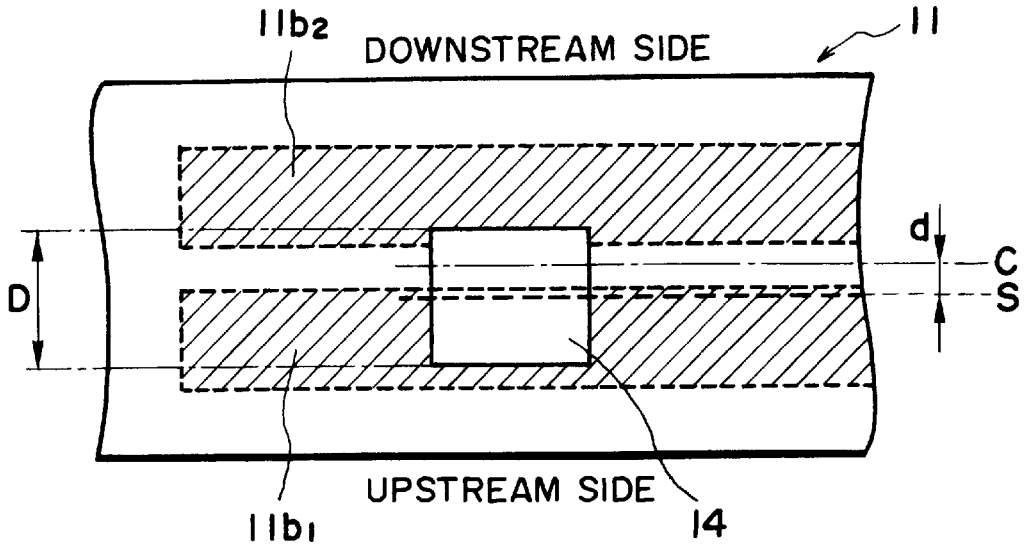
FIG. 4 is an explanation view showing the contact position between a heat-generating resistor layer and a thermistor.

FIGS. 3 and 4 shows the structure of the heater 11. As shown in FIG. 3, the heater 11 is an electrothermal heating member provided, on a highly insulating ceramic substrate 11*a* such as o f alumina, with a heat-generating resistor layer 11*b* constituting a heat generating portion and composed for example of Ag/Pd (silver-palladium), $RuO_2$ or $Ta_2N$, which is applied for example by screen printing in a linear or fine stripe form with a thickness of about 10 $\mu$m and a width of 1 to 5 mm, along the longitudinal direction of the ceramic substrate 11*a*. In the present embodiment, the heat-generating resistor layer 11*b* is formed in a folded pattern as illustrated.

The heat generating portion 11*b* is provided with a first heat generating portion $\mathbf{11}b_1$ and a second heat generating portion $\mathbf{11}b_2$, which are arranged in a direction perpendicular to the longitudinal direction of the heater. The fixing film moves in a direction perpendicular to the longitudinal direction of the heater, and the second heat generating portion $\mathbf{11}b_2$ is positioned at the downstream side of the first heat generating portion $\mathbf{11}b_1$, with respect to the moving direction of the fixing film.

The first heat generating portion $\mathbf{11}b_1$ and the second heat generating portion $\mathbf{11}b_2$ are connected by a conductive portion 11*e* at an end, and electrodes 11*d* are provided at the other ends.

On the rear face of the ceramic substrate 11*a*, there is provided a thermistor 14, constituting the temperature detecting element for detecting the temperature, elevated by the heat generated by the heat-generating resistor layer 11*b*, of the ceramic substrate 11*a*. In response to the signal from the thermistor 14, the duty ratio and/or the pulse number of the voltage applied to the heat-generating resistor layer 11*b* from the Ag/Pt (silver-platinum) electrodes 11*d* at an end in the longitudinal direction is appropriately controlled to maintain a substantially constant temperature inside the fixing nip, thereby achieving heating required for fixing the toner image on the recording material. The DC current supply from the thermistor 14 to an unrepresented temperature control unit is achieved through a DC current supply unit 14*a*, a DC electrode 14*b* and an unrepresented connector.

The thermistor 14 is fixed to the heater with an adhesive material in the following manner.

A conductive adhesive (Ag/Pd mixed in epoxy resin) with a volume resistivity of 0.005 to 0.1 Ωcm is coated between the thermistor 14 and the DC current supply unit 14*a*, and adhesion is made while the electroconductivity is secured.

Then an insulating adhesive (heat-resistant resin such as epoxy, polyimide or silicone either singly or as a mixture) is coated therearound to fix the thermistor.

The amount of these adhesives employed for fixing the thermistor are maintained minimum since otherwise the heat capacity increases.

On the surface of the heat-generating resistor layer 11*b* of the heater 11, there is provided an insulating protective layer 11*c* such as a thin glass coating, in order to achieve electrical insulation and resistance to the friction with the fixing film.

Now reference is made to FIG. 4 for explaining the positional relationship in the present embodiment between the heat-generating resistor layer 11*b* of the heater 11 and the thermistor 14 provided on the rear face thereof. As shown in FIG. 4, the thermistor 14 is positioned in contact with the heat-generating resistor layer 11*b* across the ceramic substrate 11*a*, with the central line S of the thermistor 14 being displaced by a distance d, toward the upstream side, from the central line C of the heat-generating resistor layer 11*b*. The center of the thermistor 14 is preferably positioned at the downstream side of the center of the first heat generating portion $\mathbf{11}b_1$.

The influence, on the image, of the variation of the contact position of the thermistor 14 in the upstream and downstream directions was investigated in the following manner. The image was evaluated by the toner offsetting at the high temperature and by the poor or bad toner fixation. In the heat fixing device employed in the evaluation, the heater was constructed in the following manner.

On an alumina substrate of a thickness of 500 $\mu$m, a heat-generating resistor layer of Ag/Pd (silver-palladium) was formed by screen printing in a fine stripe of a folded pattern with a thickness of about 10 $\mu$m and a width of 1.2 mm, and an insulating glass protective layer was coated thereon with a thickness of 50 $\mu$m. The gap of the folded pattern of the heat-generating resistor layer was selected as 0.6 mm. The gap of the folded pattern is preferably selected within a range from 0.3 mm to 1.0 mm, in order that the width of the heater does not become excessively large and in order to obtain a sufficiently large breakdown voltage between the AC electrodes. Also the external diameter and the hardness of the pressure roller, constituting the pressurizing member, were so selected as to obtain a fixing nip of 4 mm, and the center line C of the gap of the folded pattern of the heat-generating resistor layer was made to substantially coincide with the center of the fixing nip portion.

For the purpose of comparison, investigation was made also on a heater with a single heat-generating resistor layer as shown in the conventional configuration. In this configuration, the heat-generating resistor layer had a width of 2.4 mm and was positioned at the center of the fixing nip portion of 4 mm. In case of the conventional configuration, the center of the thermistor, constituting the temperature detecting element and positioned on the rear face of the heater, was shifted in the upstream and downstream directions with respect to the center of the heat-generating resistor layer. In both configuration of the present embodiment and conventional configuration, the temperature detected by the thermistor was 180° C. and 200° C. The temperature element employed was a chip thermistor with a width D of 2 mm (length in the conveying direction of the recording material as shown in FIG. 4).

The results of investigation are shown in the following. The distance d in the following tables indicates the amount of shift of the center line S of the thermistor in the upstream direction in the fixing nip, with respect to the center line C of the gap of the folded pattern of the heat-generating resistor layer (in case of the present embodiment) and with respect to the center line of the single heat-generating resistor layer (in case of the conventional configuration), while a negative distance indicates the amount of shift in the downstream direction, both indicated in millimeters. Also in the following tables, X indicates a satisfactory level, while Y indicates a permissible level, and Z indicates an unacceptable level.

TABLE 1

| | Controlled temperature: 180° C. | | | | | | | | | |
|---|---|---|---|---|---|---|---|---|---|---|
| | Embodiment | | | | | | Prior Art | | | |
| d (mm) | 0.7 | 0.6 | 0.5 | −0.3 | −0.4 | −0.5 | 0.3 | 0.2 | −0.2 | −0.3 |
| high-temp. offset | X | X | X | X | X | X | Y | X | X | X |
| defective fixation | X | X | X | X | Y | Z | X | X | Y | Z |

TABLE 2

| | Controlled temperature: 200° C. | | | | | | | | | |
|---|---|---|---|---|---|---|---|---|---|---|
| | Embodiment | | | | | | Prior Art | | | |
| d (mm) | 0.7 | 0.6 | 0.5 | −0.3 | −0.4 | −0.5 | 0.3 | 0.25 | −0.2 | −0.3 |
| high-temp. offset | Z | Y | X | X | X | X | Z | Y | X | X |
| defective fixation | X | X | X | X | X | X | X | X | X | Y |

As shown in these tables, the position of the thermistor in the conventional configuration significantly affects the image on the recording material, but, in the present embodiment, there can be obtained similar images despite of a certain variation in the position of the thermistor. Consequently, heat fixation without image deterioration can be achieved by employing a heater with the heat-generating resistor layer formed in a folded pattern and positioning the center line S of the thermistor within the gap of such folded pattern. In particular, it is desirable to position the thermistor at the somewhat upstream side with respect to the center line of the gap in the folded pattern of the heat-generating resistor layer, because of the following reason.

When an AC voltage is applied to the heat-generating resistor layer, the temperature distribution generally shows a peak in the vicinity of the center of the heat-generating resistor layer as shown in the conventional configuration, and the temperature becomes lower toward the upstream side and toward the downstream side. Consequently, the heat-generating resistor layer 11*b* is formed with the folded pattern as in the present embodiment, and the temperature distribution has two temperature peaks in the conveying direction of the recording material.

However, the upstream side and the downstream side of the heat-generating resistor layer in such folded pattern have the following difference in behavior. Within the fixing nip portion, the still cold fixing film 13 is inserted from the upstream side, so that the heat is absorbed by the fixing film 13 from the upstream side of the heat-generating resistor layer 11*b* of the heater 11. On the other hand, at the downstream side, the warmed fixing film 13 is discharged from the fixing nip, so that the heat escapes only by a small amount from the downstream side of the heat-generating resistor layer 11*b* of the heater 11 to the fixing film 13. Consequently, the distribution of the surface temperature of the heater 11 in the fixing nip portion shows a higher peak temperature in the downstream side than in the upstream side. Also the temperature distribution is smoother in a portion corresponding to the upstream side of the heat-generating resistor layer 11*b*. Therefore, by positioning the thermistor 14 somewhat at the upstream side of the center line of the gap of the folded pattern in the heat-generating resistor layer 11*b*, it is rendered possible to achieve temperature control for the heater as if the thermistor 14 is in its normal position, even if the position thereof fluctuates in the upstream or downstream direction.

Figure 5:
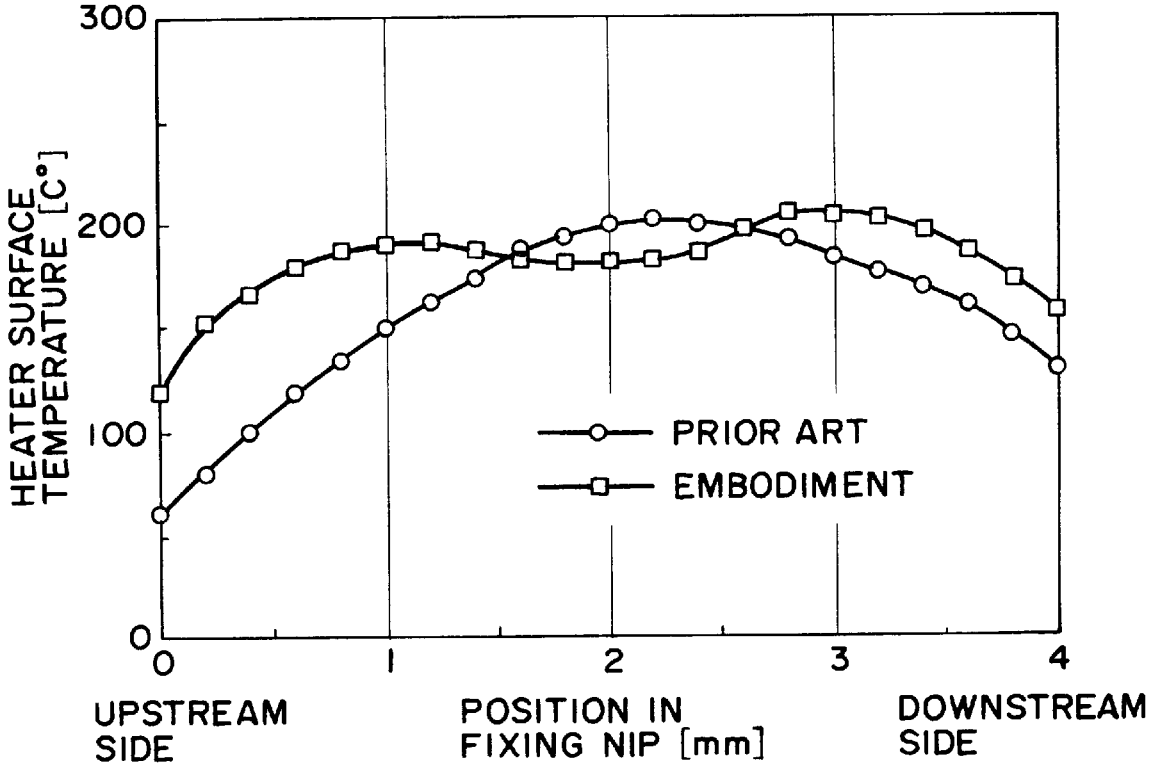
FIG. 5 is a chart showing the temperature distribution on the surface of the heater.

A chart in FIG. 5 shows the result of actual measurement of the surface temperature of the heater 11 in the fixing nip in the course of the driving operation of the fixing film 13, wherein the abscissa indicates the position within the fixing nip, while the ordinate indicates the measured surface temperature of the heater. The chart also shows the result of measurement of the temperature distribution in the conventional heater. FIG. 5 indicates that the conventional configuration has only one peak in the temperature distribution, while in the configuration of the present embodiment, the temperature distribution has two peaks and is generally higher in the upstream side than in the downstream side.

Also in the configuration of the present embodiment, the temperature distribution is generally flat, particularly in the upstream side, over the contact range of the thermistor, while, in the conventional configuration the thermistor may be contacted in a high temperature area or a low temperature area, depending on the contact position of the thermistor. Stated differently, in the conventional configuration, the contact position of the thermistor has to be selected more precisely.

In the present embodiment, as explained in the foregoing, the heat fixation without image deterioration can be achieved even in the presence of a certain fluctuation in the position of the thermistor, by positioning the center of the thermistor within the gap in the folded pattern of the heat-generating resistor layer, more particularly positioning the center of the thermistor at the upstream side of the gap of the heat-generating resistor layer. Consequently the tolerance for the position of the thermistor can be made larger, and the productivity of the heater can also be improved.

Also the present embodiment, in which the center of the thermistor is positioned at the upstream side with respect to the center of the gap in the heat-generating resistor layer, thermal deterioration in the adhesive or in the thermistor itself can be reduced, because the heat received at the upstream side is less than that received at the downstream side. In particular, the thermal deterioration of the adhesive reduces the adhesive power thereby leaving the thermistor in an open state, but the present embodiment can ensure stable temperature detection by the thermistor over a prolonged time, as it is positioned in a position of a relatively low temperature.

Figure 6:
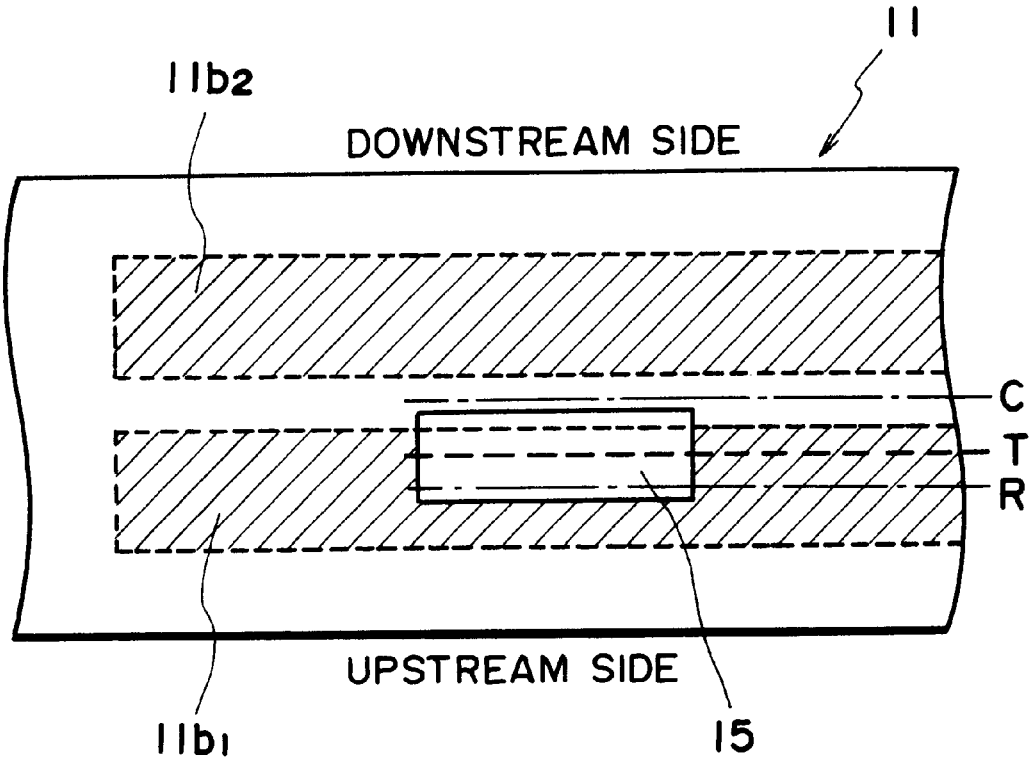
FIG. 6 is an explanation view showing the contact position between a heat-generating resistor layer and a thermo protector.

Now reference is made to FIG. 6, for explaining the thermo protector, constituting the temperature detecting element in the present invention. The present embodiment provides an optimum contact position for the thermo protector as shown in FIG. 3.

The relation of the contact position of the thermo protector relative to the heater in the present embodiment will be explained with reference to FIG. 6, in which a numeral 15 indicates the thermo protector such as a temperature fuse or a thermal switch, constituting an abnormal temperature increase preventing element for shutting down the current supply to the heat-generating resistance layer 11*b* of the heater 11, when a predetermined temperature (mainly an abnormally high temperature) is reached. The thermo protector 15 is fixed to the substrate 11*a* by a silicone adhesive.

In case of an abnormal power supply to the heat-generating resistor layer 11*b* of the heater 11, induced by a failure in the control unit for controlling the power supply to the heat-generating resistor layer 11*b* or in the safety circuit, the thermo protector 15 is activated to shut down the power supply, thereby preventing fire induced by overheating of the heat fixing device or a disabled state of the components thereof. Consequently the response speed of the thermo protector 15 in such abnormal heating state is important, and it is preferably contacted in a portion showing the highest temperature on the rear face of the heater 11.

However, in order not to shut down the power supply to the heat-generating resistor layer 11*b* in the normal state of use, the functioning temperature T of the thermo protector 15 has to be selected higher than the maximum temperature $T_{MAX}$ in the normal state of use. Consequently it is desirable to place the thermo protector in a position having a low maximum temperature $T_{MAX}$ the normal state of use but showing a largest temperature rising speed in the abnormal heating state. This is attained in the present embodiment by forming the heat-generating resistor layer 11*b* with a folded pattern and positioning the center of the thermo protector 15, on the rear face of the heater 11, within a range from the center of the gap in the folded pattern of the heat-generating resistor layer 11*b* to the center of the heat-generating resistor layer $\mathbf{11}b_1$ of the upstream side.

The heater 11 with the heat-generating resistor layer 11*b* of the folded pattern shows, in the conveying direction of the recording material, two temperature peaks as shown in FIG. 5 in the normal state of use, and the peak in the upstream side is higher than that in the downstream side. In the above-explained abnormal heating state, however, such temperature peaks at the upstream and downstream sides of the heat generating resistor layer 11*b* become almost equal because of the following reason.

The temperature of the fixing film at the entry into the fixing nip is almost same as that at the exit from the fixing nip, not only when the fixing film 13 is not rotated but also, even if the fixing film 13 is rotated, at the initial stage of power supply to the heat-generating resistor layer 11*b*. Also since the heat capacities of the pressurizing member and the fixing member are made as small as possible in order to enable quick starting, the heater has a large temperature rising speed at the abnormal heating state, so that the functioning temperature of the thermo protector 15 is reached before the downstream temperature peak of the heat-generating resistor layer can become higher than the up stream temperature peak.

It is therefore possible to achieve a high response speed for shutting down the power supply to the heat-generating resistor layer 11*b* in case of the abnormal heating state, by positioning, on the rear face of the ceramic substrate 11*a*, the e center T of the thermo protector 15 within a range from the center of the gap in the folded pattern of the heat-generating resistor layer 11*b* to the center R of the heat-generating resistor layer $\mathbf{11}b_1$ of the upstream side, where the heater 11 shows a relatively low maximum temperature in the normal state of use but a high temperature rising rate in the abnormal heating state. Such positioning is satisfactorily applicable also to a heat fixing device employing a higher power for reaching the image fixing state in a faster manner, in order to further improve the quick start performance or to further increase the printing speed in the image forming apparatus.

The present embodiment can reduce the thermal deterioration in the thermo protector itself or in the adhesive employed for fixing the thermo protector, because the thermo protector is provided in the upstream side of a relatively low temperature.

In the foregoing embodiments, the heat-generating resistor layers $\mathbf{11}b_1$ and $\mathbf{11}b_2$ have a same amount of heat generation, but it is also possible to select the amount of heat generation of the heat-generating resistor layer of the upstream side larger than that of the downstream side and to reduce the amount of heat generation at the downstream side within an extent that the temperature distribution in the upstream side does not become higher than that in the downstream side in the course of film drive.

In such arrangement, the toner image is mainly heated and fused in the upstream side of the fixing nip and tends to stick to the recording material in the downstream side, whereby the image deterioration such as the toner offsetting at the high temperature can be suppressed.

It is also possible to prevent the overheating of the downstream side of the fixing nip, even in case of conveying a recording material of a smaller size.

It is also possible to further improve the response speed of the thermo protector in case of the abnormal heating state, by positioning, as explained in the foregoing embodiments, the center of the thermo protector which shuts down the power supply to the heat-generating resistor layer at a predetermined temperature within a range on the rear face of the heater 11 from the center of the gap in the folded pattern of the heat-generating resistor layer 11*b* to the center of the heat-generating resistor layer 11*b* of the upstream side.

In the foregoing embodiments, the heat-generating resistor layer of the folded pattern receives the power supply from an either end. In the following there will be explained an embodiment in which the heat-generating resistor layers are independently given power supplies.

Figure 7:
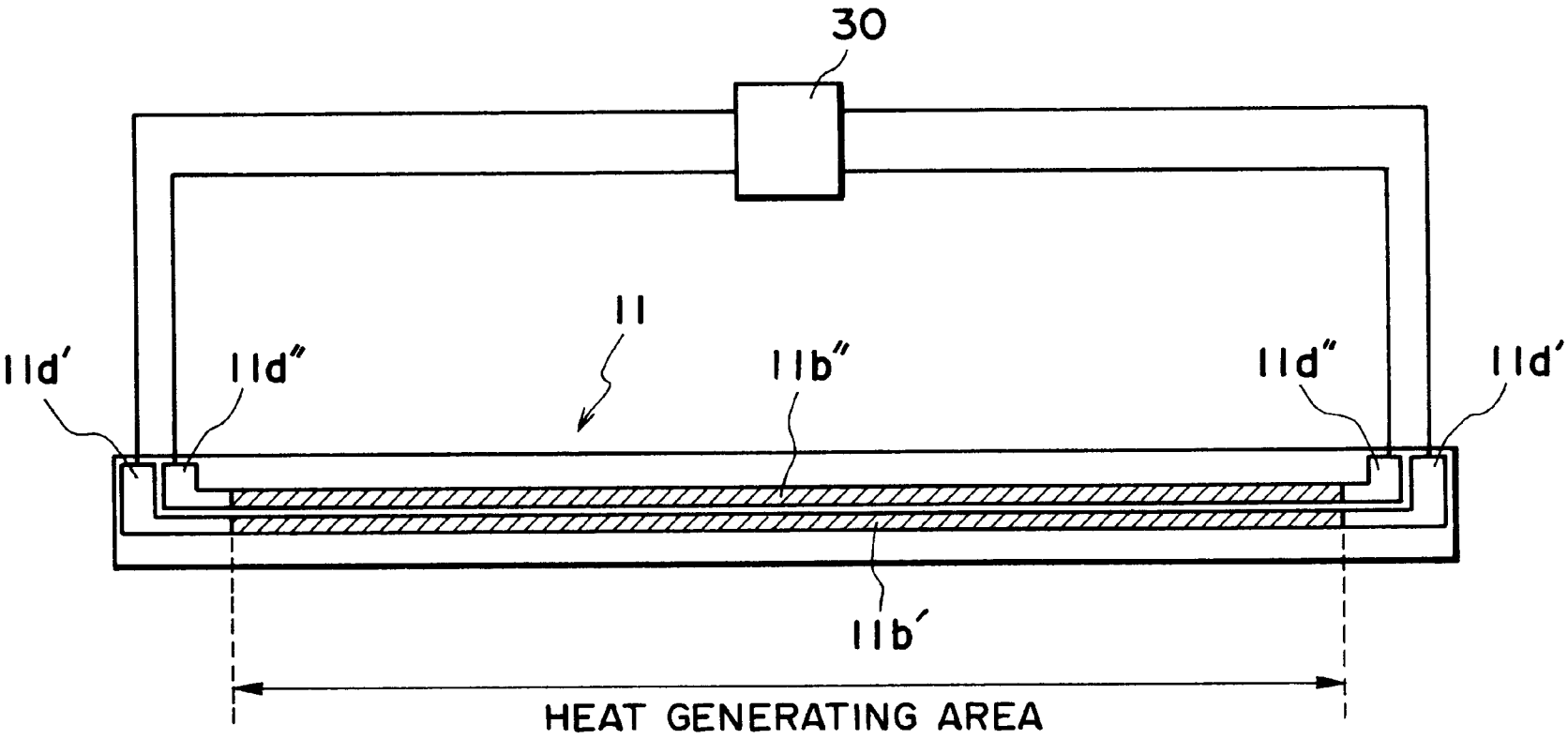
FIG. 7 is a construction view of a heater constituting an embodiment of the present invention.
Figure 8:
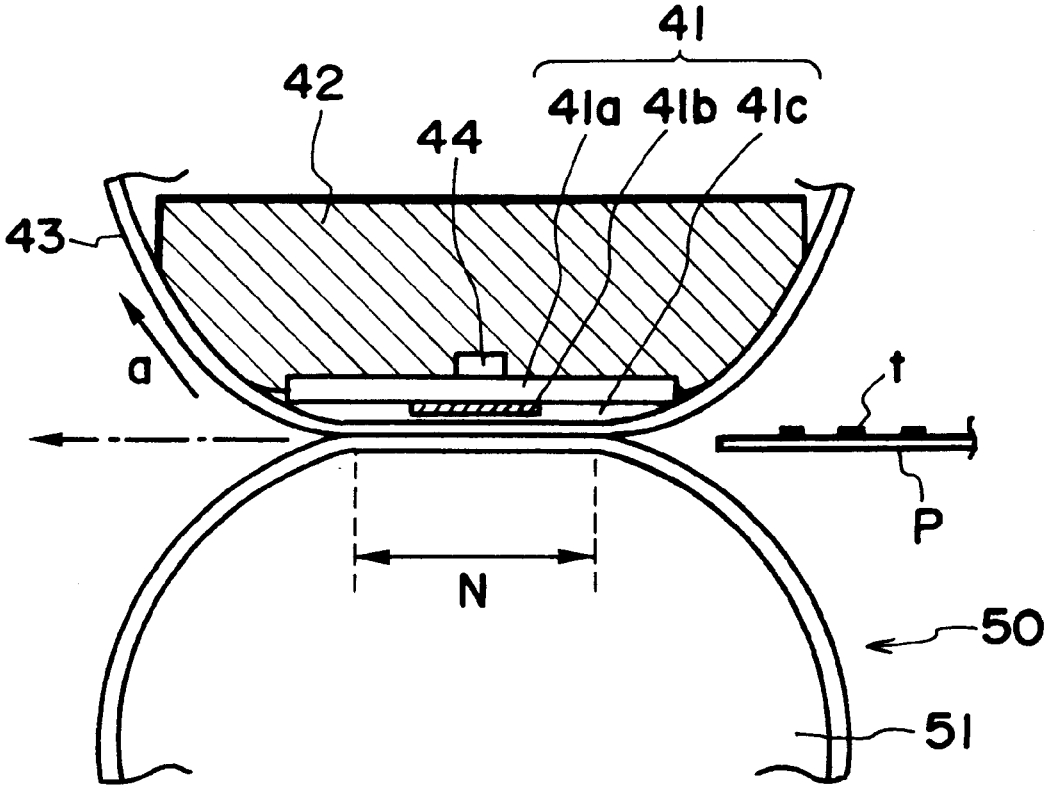
FIG. 8 is a main construction view showing an example of the conventional image heating apparatus.
Figure 9:
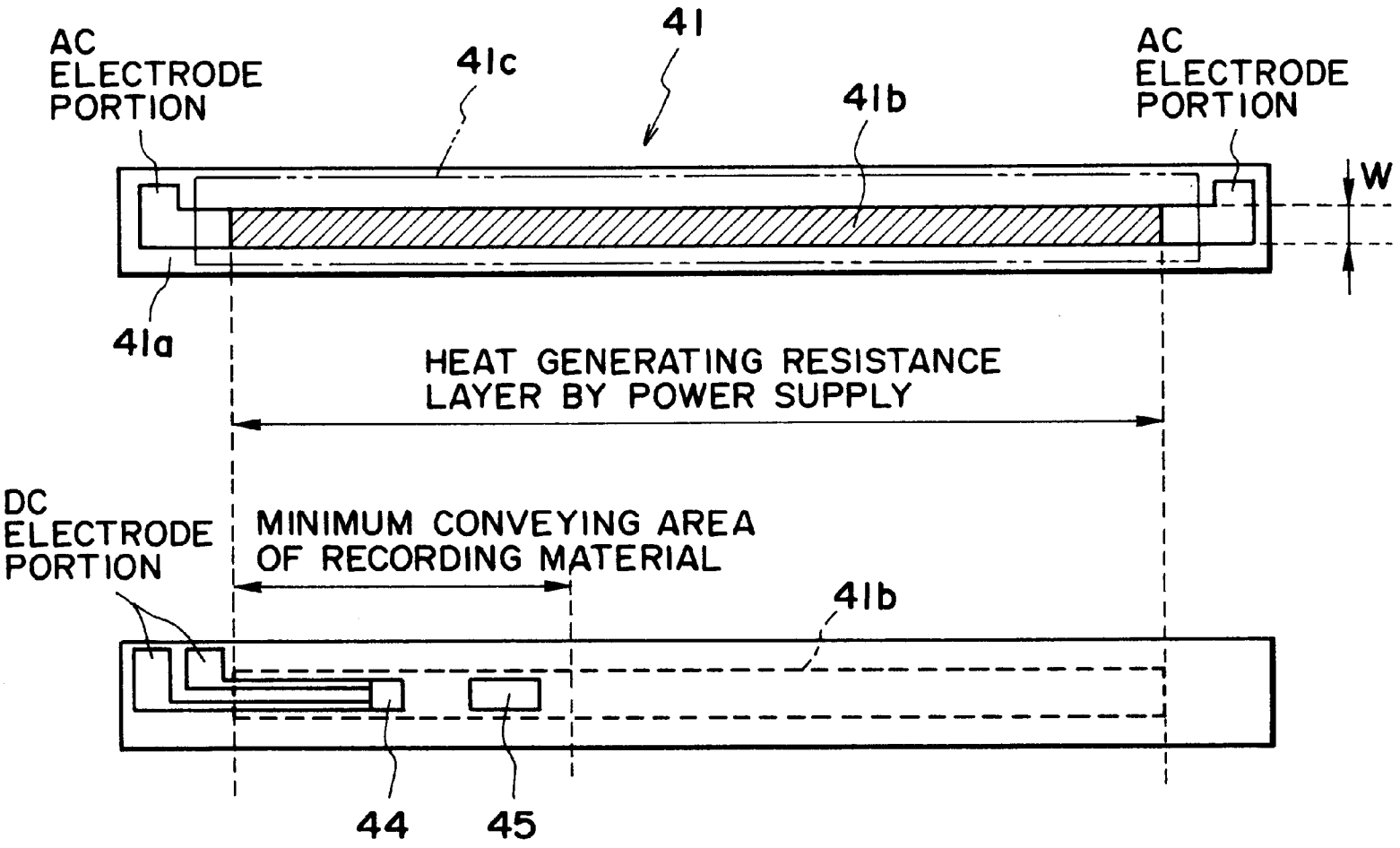
FIG. 9 is a construction showing an example of the conventional heater.
Figure 10:
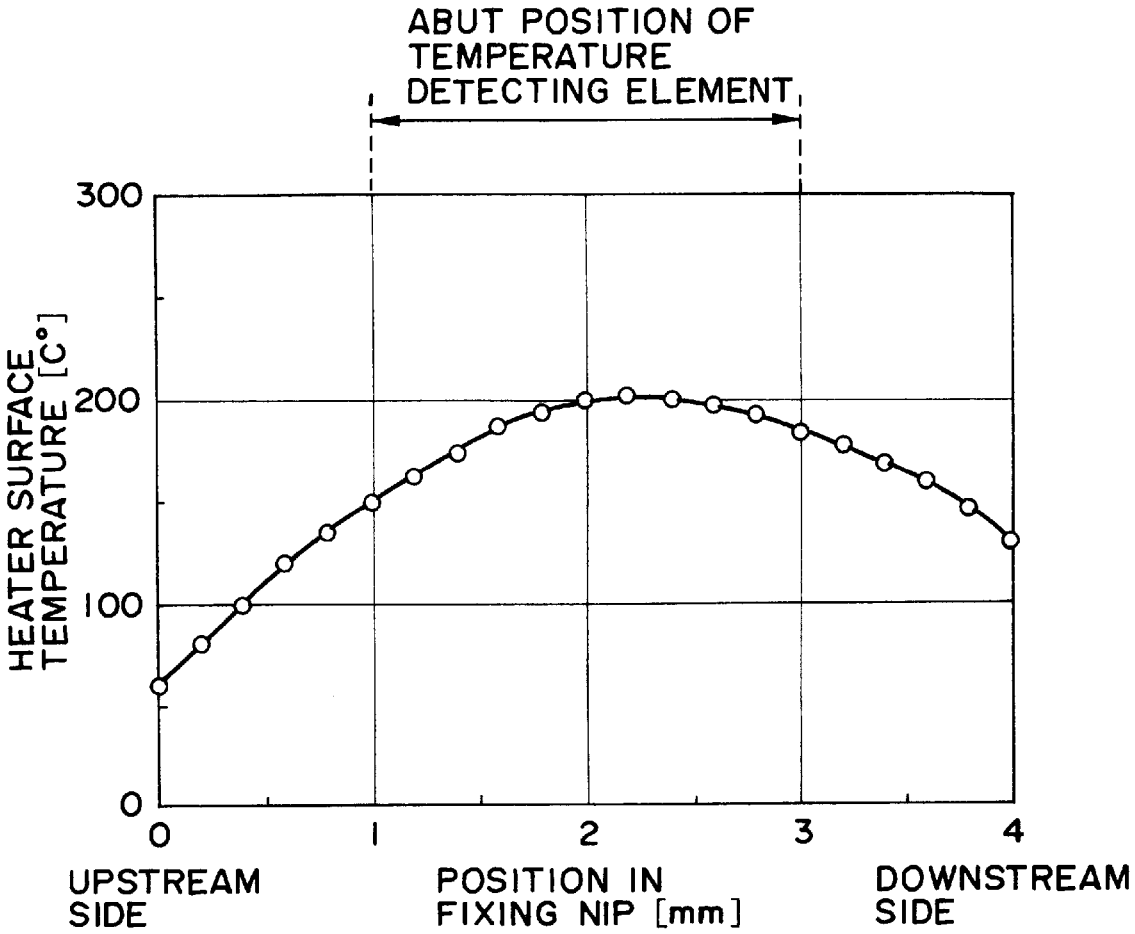
FIG. 10 is a chart showing the temperature distribution on the surface of the heater shown in FIG. 9.

In this embodiment, as shown in FIG. 7, a heat-generating resistor layer 11*b*' formed on the heater 11 is powered through electrode portions 11*d*' while another heat-generating resistor layer 11*b*" is powered through electrode portions 11*d*". The electrodes at either end in the longitudinal direction may be formed as a single common electrode.

In case such heat-generating resistor layers 11*b*', 11*b*" are separately controlled by a control circuit 30, and if the power consumption is divided equally between such heat-generating resistor layers, the resistance in each heat-generating resistor layer 11*b*'and 11*b*" can be approximately doubled in comparison with the resistance R of the heat-generating resistor layer 11*b* of the folded pattern in the foregoing embodiment, in order to obtain an equivalent heat fixation. Consequently the fluctuation in the current in each heat-generating resistor layer is reduced, whereby the drawbacks such as flickering or harmonic distortion can be avoided.

Particularly in case of designing an image forming apparatus with a higher quick starting performance or a higher printing speed, a larger electric power is required in the heat fixing device in order to reach the image fixing state in a shorter time, leading to a larger fluctuation of the current in the heat-generating resistor layer and eventually resulting in a flickering or a harmonic distortion. However the divided structure of the heat-generating resistor layer in the present embodiment allows to bring the heat fixing device to the operable state within a shorter time, without inducing such drawbacks.

The resistance of the two heat-generating resistor layers 11*b*', 11*b*" need not be mutually equal, but the resistance of the heat-generating resistor layer 11*b*' in the upstream side may be selected lower than that of the layer 11*b*" in the downstream side in order that the amount of heat generation in the upstream side becomes higher than that in the downstream side as explained in the foregoing embodiment. It is also possible to increase the amount of heat generation in the upstream side by increasing the power supply time to the heat-generating resistor layer 11*b*' of the upstream side, in comparison with that to the layer 11*b*" of the downstream side.

Also in this embodiment, it is possible to obtain the effects of the foregoing embodiments by positioning the thermistor or the thermo protector, constituting the temperature detecting elements, in the upstream side where the temperature distribution is relatively low.

The present invention has been explained by the preferred embodiments thereof, but it is by no means limited by such embodiments and is subject to any and all modifications within the technical scope and spirit of the appended claims.

What is claimed is:

1. An image heating apparatus comprising:

a heater having a heat generating portion on a substrate;

a film one face of which is in sliding contact with said heater and the other face of which contacts with a recording material bearing an image thereon and moves with said recording material, said image on said recording material being heated by a heat generated by said heater and transmitted through said film; and a temperature detecting element for detecting a temperature of said heater;

wherein said heat generating portion of said heater includes a first heat generating portion and a second heat generating portion provided at a downstream side of said first heat generating portion with respect to a moving direction of said film, and a middle of said temperature detecting element is positioned at an upstream side of a middle between said first and second heat generating portions, with respect to the moving direction of said film.

2. An image heating apparatus according to claim 1, wherein the middle of said temperature detecting element is positioned at a downstream side of a middle of the first heat generating portion, with respect to the moving direction of said film.

3. An image heating apparatus according to claim 1, wherein said substrate is plate shaped and said temperature detecting element is provided on a face opposite to a face on which said heat generating portions are provided.

4. An image heating apparatus according to claim 1, wherein said substrate is elongated in a direction perpendicular to the moving direction of said film, and said first and second heat generating portions are provided along a longitudinal direction, which is the same direction as the direction perpendicular to the moving direction of said film, of said substrate.

5. An image heating apparatus according to claim 4, wherein an end of said first heat generating portion and an end of said second heat generating portion are connected at an electrically conductive portion and each other end thereof is provided with an electrode, and said first and second heat generating portions are supplied with electric power by an application of a voltage between said both electrodes.

6. An image heating apparatus according to claim 4, wherein each of said first and second heat generating portions is provided at both ends with electrodes, and said first and second heat generating portions are independently given voltages to be supplied electric power.

7. An image heating apparatus according to claim 1, wherein said heater is so controlled as to reach to a predetermined temperature based on an output of said temperature detecting element.

8. An image heating apparatus according to claim 7, wherein said temperature detecting element is a thermistor.

9. An image heating apparatus according to claim 1, wherein said temperature detecting element interrupts an electric power supply to said heat generating portions in case of an abnormal temperature rise of said heater.

10. An image heating apparatus according to claim 9, wherein said temperature detecting element is a thermoswitch or a temperature fuse.

11. An image heating apparatus according to claim 1, wherein said temperature detecting element is fixed to said heater with an adhesive.

12. An image heating apparatus according to claim 1, further comprising a back-up member for forming a nip with said heater via said film, wherein the recording material bearing an unfixed image thereon is nipped and conveyed through said nip so that the unfixed image is fixed thereof.

13. A heater for image heating, comprising:

an elongated substrate;

a first heat generating portion and a second heat generating portion respectively provided along a longitudinal direction of said substrate, said first and second heat generating portions being provided in parallel in a direction perpendicular to the longitudinal direction of said substrate; and a temperature detecting element for detecting temperature, a middle of said temperature detecting element being put aside toward said first heat generating portion from a middle between said first and second heat generating portions.

14. A heater according to claim 13, wherein said substrate is plate shaped and said temperature detecting element is provided on a face opposite to a face on which said heat generating portions are provided.

15. A heater according to claim 13, wherein an end of said first and second heat generating portion and an end of said second heat generating portion are connected at an electrically conductive portion and each other end thereof is provided with an electrode, and said first and second heat generating portions are supplied with electric power by an application of a voltage between said both electrodes.

16. A heater according to claim 13, wherein each of said first and second heat generating portions is provided at both ends with electrodes and said first and second heat generating portions are independently given voltages to be supplied electric power.

17. A heater according to claim 13, wherein said heater is so controlled as to reach to a predetermined temperature based on an output of said temperature detecting element.

18. A heater according to claim 17, wherein said temperature detecting element is a thermistor.

19. A heater according to claim 13, wherein said temperature detecting element interrupts an electric power supply to said heat generating portions in case of an abnormal temperature rise of said heater.

20. A heater according to claim 19, wherein said temperature detecting element is a thermoswitch or a temperature fuse.

21. A heater according to claim 13, wherein said temperature detecting element is fixed to said heater with an adhesive.

* * * * *

UNITED STATES PATENT AND TRADEMARK OFFICE

CERTIFICATE OF CORRECTION

PATENT NO. : 5,920,757

DATED : July 6, 1999

INVENTOR(S): SATORU IZAWA, ET AL.

It is certified that error appears in the above-identified patent and that said Letters Patent is hereby corrected as shown below:

COLUMN 1,
Line 20, "has" should read -have-.

COLUMN 4,
Line 20, "heating" should read -heat-;
Line 27, "heating" should read -heat-; and
Line 58, "construction" should read -construction view-.

COLUMN 8,
Line 39, "despite of" should read -despite-.

COLUMN 9,
Line 47, "Also" should read -Also in-.

COLUMN 10,
Line 39, "e center" should read -center--.

UNITED STATES PATENT AND TRADEMARK OFFICE

CERTIFICATE OF CORRECTION

PATENT NO. : 5,920,757

DATED : July 6, 1999

INVENTOR(S): SATORU IZAWA, ET AL.

It is certified that error appears in the above-identified patent and that said Letters Patent is hereby corrected as shown below:

COLUMN 11,
Line 39, "an" should be deleted; and
Line 53, "11b'and" should read -11b' and-.

Signed and Sealed this

Eleventh Day of January, 2000

*Attest:*

*Attesting Officer*

Q. TODD DICKINSON

*Acting Commissioner of Patents and Trademarks*